US006158370A

United States Patent [19]

French et al.

[11] Patent Number: 6,158,370

[45] Date of Patent: Dec. 12, 2000

[54] SUBMERSIBLE UNDERWATER VEHICLE BALLAST EQUALIZATION SYSTEM

[75] Inventors: Daniel W. French, Portsmouth, R.I.; Theodore C. Gagliardi, Somerset, Mass.; John J. Vaillancourt, Tiverton, R.I.

[73] Assignee: The United States of America as represented by the Secretary of the Navy, Washington, D.C.

[21] Appl. No.: 09/413,060

[22] Filed: Oct. 4, 1999

[51] Int. Cl.[7] ..... B63B 9/08

[52] U.S. Cl. ..... 114/121; 114/317; 114/330

[58] Field of Search ..... 114/317, 318, 114/312, 330, 333, 121, 123, 125; 441/33

[56] References Cited

U.S. PATENT DOCUMENTS

| | | | |
|---|---|---|---|
| 4,721,055 | 1/1988 | Pado | 114/330 |
| 5,163,379 | 11/1992 | Chorley | 114/317 |
| 5,675,117 | 10/1997 | Hillenbrand | 114/317 |

*Primary Examiner*—Stephen Avila

*Attorney, Agent, or Firm*—Michael J. McGowan; James M. Kasischke; Prithvi C. Lall

[57] ABSTRACT

A system for equalizing buoyancy of a submersible vehicle. The buoyancy equalization system includes a submersible vehicle having a plurality of releasable objects. Ballast release means are positioned on the submersible vehicle, and a plurality of ballast vessels are joined to said submersible vehicle by the ballast release means. One ballast vessel is released upon release of one of said releasable objects in order to equalize buoyancy.

14 Claims, 4 Drawing Sheets

POSITIVE BUOYANCY AND PUSH FROM RELEASED ROD JETTISON THE VESSEL AWAY FROM HOST PLATFORM

AXIAL FORCE APPLIED TO RELEASED ROD

CLOSED (FIXED) POSITION

SUBMERSIBLE UNDERWATER VEHICLE BALLAST EQUALIZATION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1). Field of the Invention

The present invention relates to submersible vessels and more particularly to such vessels with ballast compensating means used in conjunction with weapons systems.

(2). Brief Description of the Prior Art

The launching of a weapon or equipment from a submersible vehicle results in significant negative buoyancy due to the release of the weight and buoyant force of the weapon or equipment. Various approaches to this problem are suggested by the prior art. U.S. Pat. No. 3,356,056 to Lehmann, for example, discloses a missile and torpedo firing submarine that carries a series of weapons on a revolving platform and ejects them from only one opening at the rear under full submergence speed. The submarine is equipped with automatic ballast in which buoyancy compensation after missile release is accomplished by water exchange.

U.S. Pat. No. 3,368,510 to Humphrey discloses a mine laying submarine in which buoyancy tanks are used to adjust trim after mine release. A valve is connected to water supply lines for admitting water to the buoyancy tanks and for expelling water form the tanks after the mines have been released.

U.S. Pat. No. 3,716,010 to Wilson et al. discloses a snap acting ballast release device for a torpedo. The hull of the torpedo has an angular release and a plurality of waste is disposed within the release. A resilient band extends around the weights and secures them in a closed bias position. Upon release of the ends of the band, the band and its attached weight snap free from the torpedo, thus releasing ballast weights to allow the torpedo to surface.

U.S. Pat. No. 4,777,819 to Hoyt et al. discloses a method and apparatus for making depth-related measurements from an unteathered, gravity driven oceanographic platform. The platform is comprised of a smooth, streamlined torpedo shaped body that releasably carries ballast in its nose and is covered with foam for buoyancy. At the appropriate depth, the ballast is released and the body ascends to the surface.

U.S. Pat. No. 5,163,379 to Chorley discloses a mine deployment system that includes ballast compensation based on the filling and emptying of ballast tanks. The rigid chamber has an opening at one end. The chamber contains air and atmospheric pressure and is sealed by a piston. The piston is held in position by a piston release to prevent from moving under pressure from the surrounding water. A buoyancy control unit is attached to an object deployment device and when the object is released the piston release is removed by solenoid pulling a cord which allows the piston to move. The decrease in buoyancy from the compression of air and filling the chamber with water compensates for the increase in buoyancy created when the object is jettisoned from the unit.

U.S. Pat. No. 5,675,117 to Hillendbrand discloses an unmanned undersea vehicle system that includes an axisymetrical, cylindrical shaped, self-propelled undersea deployment vehicle. Buoyancy tanks are provided with actuable valves to allow for a controllable path to enable seawater exterior of the weapon compartment to flow into respective buoyancy tanks during deployment and firing of the weapons.

These means are difficult to use with autonomous vehicles because they do not allow trim to be set upon provisioning of a vessel. Internal ballast tanks cannot be easily configured to instantaneously offset the ballast requirements of a weapons launch. All of these methods have the problem of creating an instantaneous force on the vehicle during filling of the ballast tank.

SUMMARY OF THE INVENTION

It is an object of the present invention to provide a means for adjusting buoyancy in a submerged vessel, which results from the release of a torpedo or other object.

It is a further object of this invention to provide a ballast system which can compensate instantaneously for changes on release of the torpedo or other object.

Accordingly, the present invention provides a system for equalizing buoyancy of a submersible vehicle. The buoyancy equalization system includes a submersible vehicle having a plurality of releasable objects. Ballast release means are positioned on the submersible vehicle, and a plurality of ballast vessels are joined to said submersible vehicle by the ballast release means. One ballast vessel is released upon release of one of said releasable objects in order to equalize buoyancy.

BRIEF DESCRIPTION OF THE DRAWINGS

Other objects, features and advantages of the present invention will become apparent upon reference to the following description of the preferred embodiments and to the drawing, wherein corresponding reference characters indicate corresponding parts in the drawing and wherein.

The FIG. 1 is a perspective view of an unmanned underwater vehicle and preferred embodiment of the system of the present invention.

DESCRIPTION OF THE PREFERRED EMBODIMENT

Figure 1:
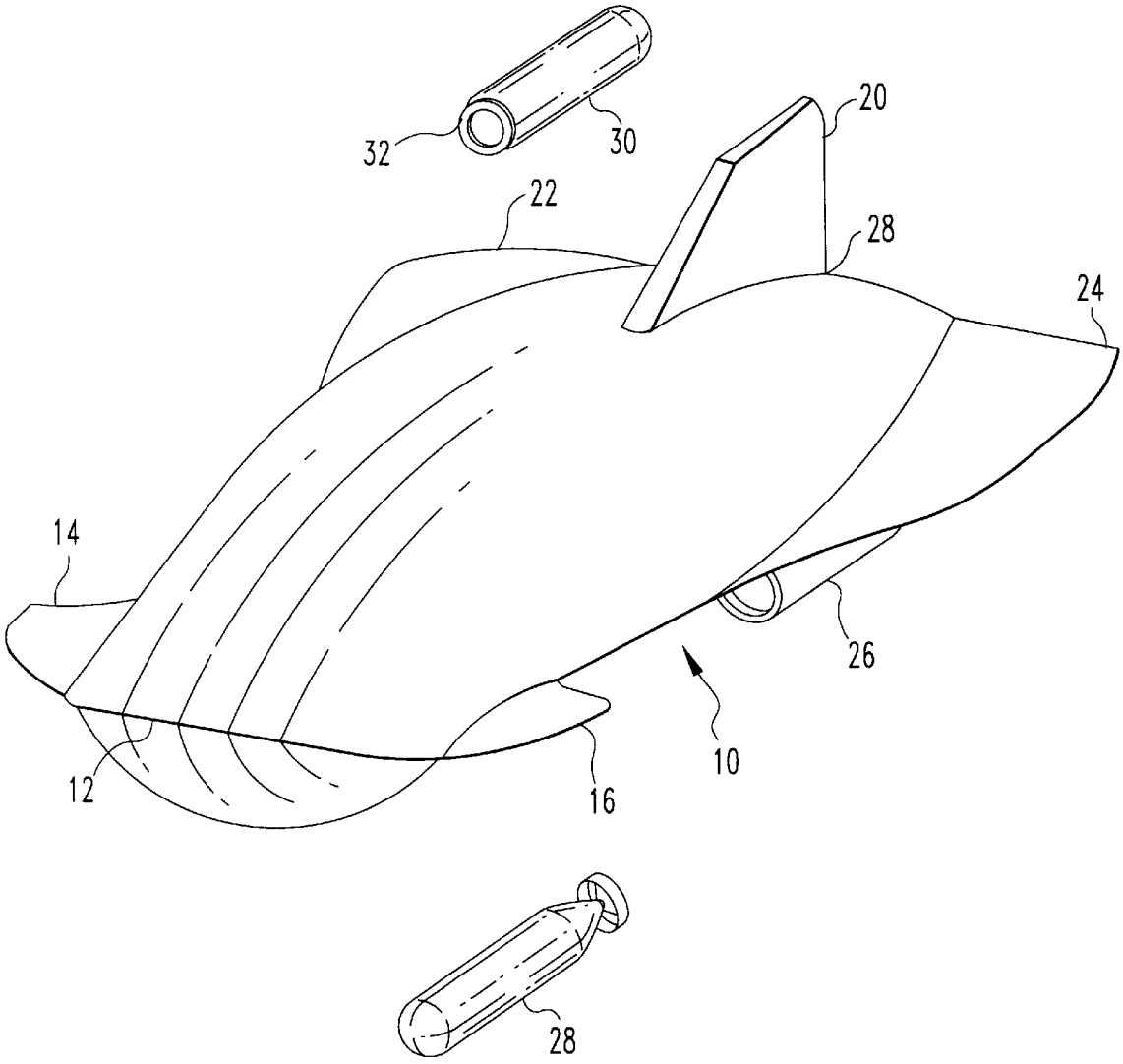

Referring to FIG. 1, an unmanned underwater vehicle is shown at 10. Such unmanned underwater vehicles are well known in the art. Adjacent its bow 12 there are lateral planes 14 and 16. Adjacent its stern 18 there is a rudder 20 and lateral planes 22 and 24. Mounted below the unmanned underwater vehicle 10 and adjacent lateral plane 24, there is a deployment device 26. Mounted beneath the unmanned underwater vehicle 10 and adjacent the lateral plane 22, there is a second deployment device (not shown). From deployment device 26, a negatively buoyant object 28 may be launched. A similar object (not shown) can be launched from the other deployment device (not shown). A positively buoyant ballast equalization vessel 30 is launched simultaneously with the object launch to equalize the negative buoyancy caused by the object launch. This ballast equalization vessel 30 is equipped with a scuttle valve 32 to allow the vessel 30 to sink to the bottom so that the unmanned underwater vehicle can continue on its mission without being detected. The vessel 30 may either be abandoned or recovered later.

Figure 2:
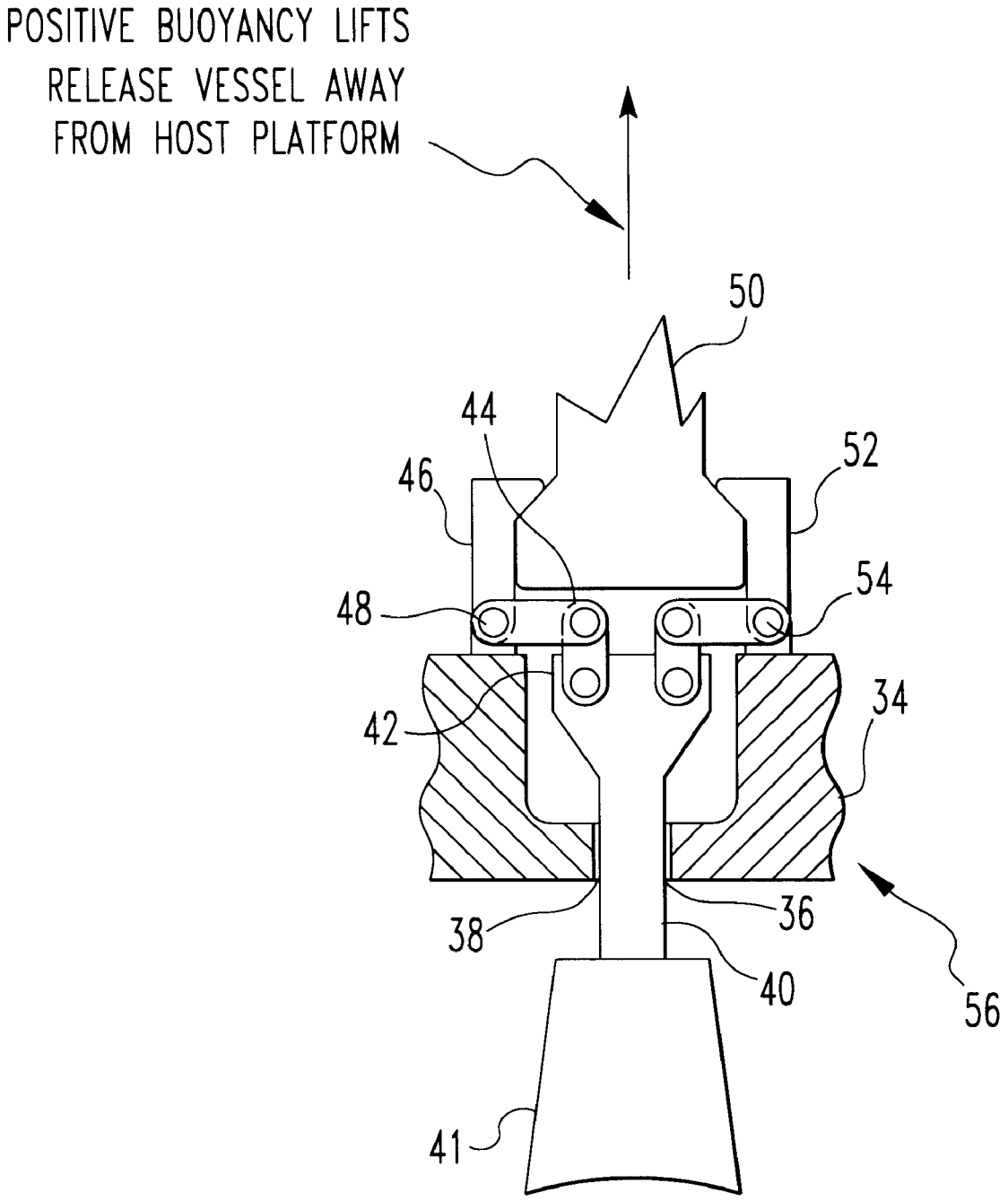
FIG. 2 is a front elevational view of the grappling/release hook assembly used in the unmanned underwater vehicle shown in FIG. 1.

Referring to FIG. 2, there is shown a release mechanism 56 joined to a fixed portion 34 of the underwater vessel 10. An aperture 36 having a surrounding sleeve bearing 38 extends through portion 34 joined to an actuator 41. A rod 40 extends through the aperture 36. Actuator 41 extends and retracts rod 40 in an axial direction. Actuator 41 can be either a hydraulic, pneumatic or electromagnetic actuator. There is a release rod link 42, which is attached to a release rod 44 on a grappling/release hook 46. The grappling/release hook 46 is attached to the host platform 34 at a pivot point 48. The grappling/release hook 46 holds an attachment 50 joined to the vessel 30 (FIG. 1). A second grappling/release hook 52, which is a mirror image of grappling/release hook 46 and its attending structure is also provided to secure the attachment 50 from the opposite direction.

Figure 3C:
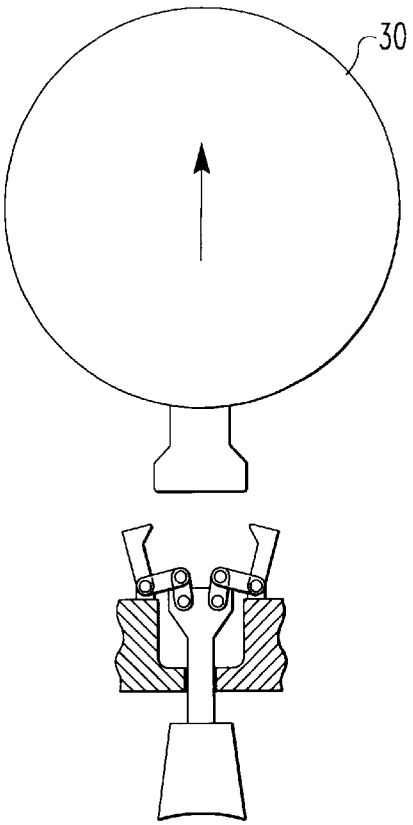
FIGS. 3*a*, 3*b* and 3*c* are schematic views showing the sequences for jettison of the release vessel from the grappling/release vessel from the grappling/release hook assembly shown in FIG. 2.
Figure 3B:
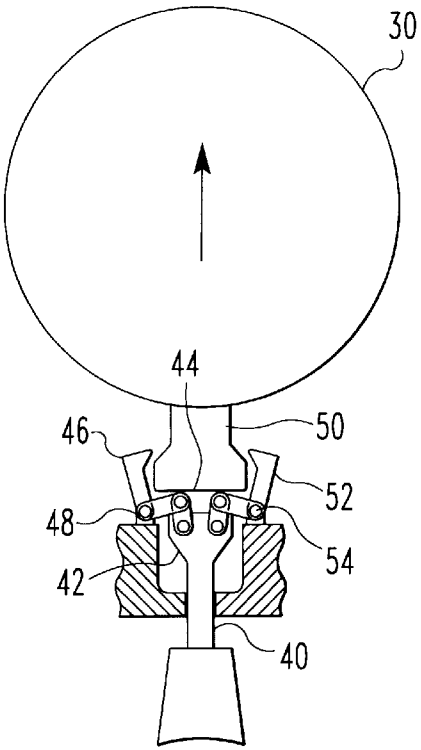
Figure 3A:
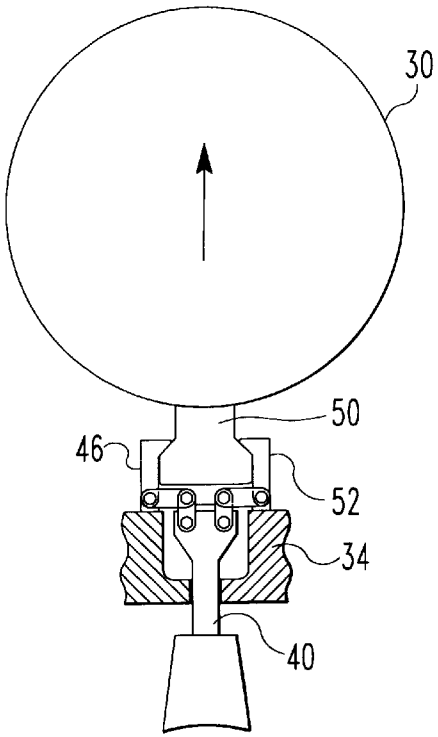

Referring to FIG. 3*a*, the attachment 50 of the vessel 30 is initially held between the grappling/release hooks 46 and 52. As is then shown in FIG. 3*b*, actuator 41 then moves rod 40 upwardly causing the rod 40 to pivot on release rod link 42 and causing the grappling/release hooks 46 and 52 to pivot on pivot points 42 and 54. The grappling /release hooks 46 and 52 are thereby released from the attachment 50 of the vessel 30. Referring to FIG. 3*c*, it will be seen that after the grappling/release hooks 46 and 52 disengage the attachment 50, the release vessel 30 moves upwardly away form the unmanned underwater vessel 10. Actuation of rod 40 should occur simultaneously with launching of the object in order to avoid instances of positive buoyancy.

Figure 4:
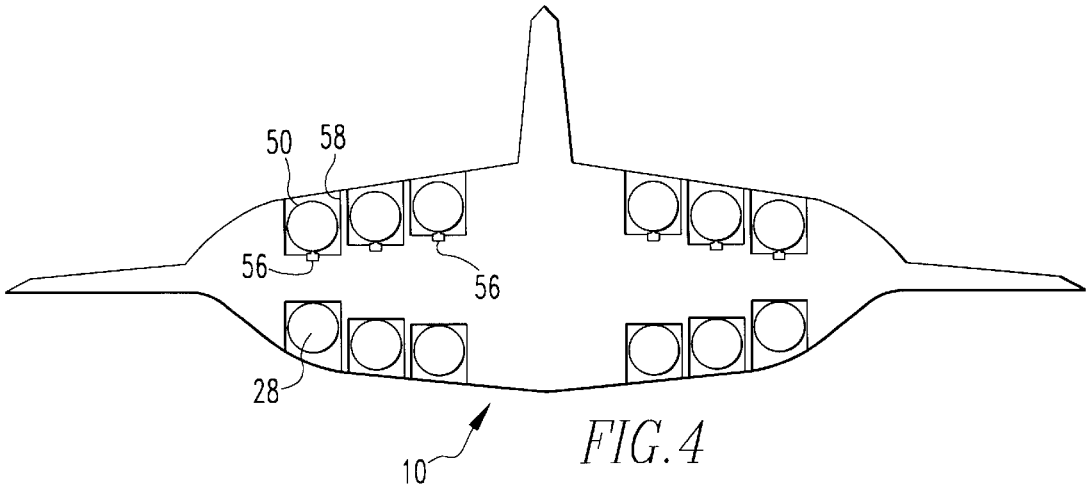
FIG. 4 is a cross sectional schematic view of an unmanned underwater vehicle incorporating a first embodiment of the system of the present invention.

As shown in FIG. 4, vessel 30 can be attached within cavity 58 formed in the upper hull surface of the vehicle 10. This cavity 58 can be either open or covered by a hydrodynamic structure such as a door or membrane. Vessel 30 is fastened to vehicle 10 by release mechanism 56. As shown a plurality of vessels 30 and cavities 58 each corresponding to an object 28 can be positioned on the vehicle 10. In order to avoid application of a torque, the vessel 30 should be positioned so that its center of buoyancy is directly over the center of gravity of the object.

Figure 5:
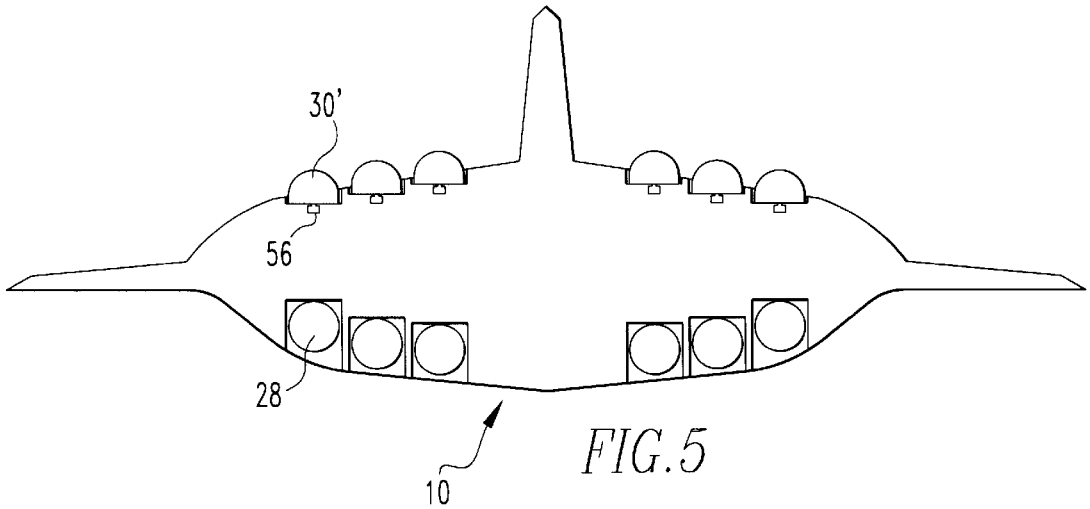
FIG. 5 is a cross sectional schematic view of an unmanned underwater vehicle incorporating a second embodiment of the system of the present invention.

As shown in FIG. 5, there is an alternative deployment of vessels 30' on the surface of vehicle 10. In this embodiment, each vessel 30' has a hydrodynamic shape. Vessels 30' are joined by release mechanisms 56 directly to the upper hull surface of vehicle 10. As before, vessels 30' are positioned so that each vessel's center of buoyancy is above the center of gravity of the object.

Before launch of vehicle 10, vessel 30 or 30' can be configured to exactly match the buoyancy of the object 28 by partially filling the vessel with fluid, sizing the vessel to counteract the buoyancy of the object 28 or attaching weights to the vessel.

It will be appreciated that a method and system have been described, which allow for an efficient adjustment of buoyancy when a torpedo or other object is released from a submersible vehicle.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A buoyancy equalization system comprising:

a submersible vehicle having a plurality of releasable objects;

a plurality of ballast release means positioned on said submersible vehicle; and a plurality of ballast vessels with each joined to said submersible vehicle by one of said plurality of ballast release means, said ballast vessel being released upon release of one of said releasable objects for equalizing buoyancy.

2. The system of claim 1 wherein the buoyancy of one of said plurality of ballast vessels is the opposite of a corresponding one of said plurality of releasable objects.

3. The system of claim 2 wherein said one ballast vessel is positioned on said submersible vehicle such that the center of buoyancy of said ballast vessel is along the same vertical line as the center of buoyancy of said corresponding releasable object.

4. The system of claim 3 wherein:

said plurality of releasable objects are negatively buoyant; and said plurality of ballast vessels are positively buoyant.

5. The system of claim 4 wherein said ballast vessel comprises:

a rigid outer shell; and gaseous ballast located within said rigid outer shell.

6. The system of claim 5 further comprising a scuttle charge joined to said rigid outer shell, said scuttle charge releasing said gaseous ballast a preset time after release from said submersible vehicle.

7. The system of claim 6 wherein said rigid outer shell is cylindrical.

8. The system of claim 3 wherein said ballast vessels are releasably affixed to a top surface of said submersible vehicle.

9. The system of claim 8 wherein said plurality of ballast vessels have a hydrodynamic shape.

10. A buoyancy equalization system comprising:

a submersible vehicle has a plurality of cavities formed in the upper surface thereof and a plurality of releasable objects; and a plurality of ballast release means positioned on said submersible vehicle;

a plurality of ballast vessels with each joined to said submersible vehicle by one of said plurality of ballast release means and releasably affixed to the top surface of said submersible vehicle, said ballast vessel being released upon release of one of said releasable objects for equalizing buoyancy, the buoyancy of one of said plurality of ballast vessels being the opposite of a corresponding one of said plurality of releasable objects, said one ballast vessel being positioned on said submersible vehicle such that the center of buoyancy of said ballast vessel is along the same vertical line as the center of buoyancy of said corresponding releasable object, and said plurality of ballast vessels are positioned with each ballast vessel positioned in one of said plurality of cavities.

11. A buoyancy equalization system comprising:

a submersible vehicle having a plurality of releasable objects;

a plurality of ballast release means positioned on said submersible vehicle; and a plurality of ballast vessels with each joined to said submersible vehicle by one of said plurality of ballast release means, said ballast vessel being released upon release of one of said releasable objects for equalizing buoyancy;

wherein each of said plurality of ballast release means further comprises:

a linear actuator;

a rod having an inboard end joined to said actuator and an outboard end;

at least two links, each link having a first end joined pivotally to said rod outboard end and a second end;

at least two hooks, each having a hook portion, an intermediate bend pivotally joined to said submersible vehicle, and a lever portion pivotally joined to one of said at least two links at said second end of said link; and an attachment joined to one of said plurality of ballast vessels having shoulders being held by said hook portions before release, actuation of said actuator causing outboard movement of said rod, said links pivoting said hooks for releasing said hook portions from said shoulders of said attachment thereby releasing said ballast vessel.

12. The system of claim 11 wherein said linear actuator is a hydraulic actuator.

13. The system of claim 11 wherein said linear actuator is a solenoid.

14. The system of claim 11 wherein said linear actuator is a pneumatic actuator.

* * * * *